United States Patent [19]

Rhoades

[11] 4,353,546

[45] Oct. 12, 1982

[54] DALLY PRACTICE APPARATUS

[76] Inventor: James J. Rhoades, 7147 W. Country Gables, Peoria, Ariz. 85345

[21] Appl. No.: 40,711

[22] Filed: May 21, 1979

[51] Int. Cl.[3] ..... A63B 21/06

[52] U.S. Cl. ..... 272/117; 434/247

[58] Field of Search ..... 272/134, 133, 117, 52; 35/29 R; 434/247; 46/1 D; 119/153; 273/126 E

[56] References Cited

U.S. PATENT DOCUMENTS

| | | | |
|---|---|---|---|
| 244,388 | 7/1881 | Gifford | 272/117 |
| 3,166,317 | 1/1965 | Tumelson | 273/26 E |
| 3,268,224 | 8/1966 | Freshour | 272/117 |
| 3,708,167 | 1/1973 | Patgietor | 272/117 |

FOREIGN PATENT DOCUMENTS

| | | | |
|---|---|---|---|
| 161789 | 6/1905 | Fed. Rep. of Germany | 272/117 |
| 2335022 | 1/1975 | Fed. Rep. of Germany | 272/134 |

*Primary Examiner*—Richard C. Pinkham
*Assistant Examiner*—T. Brown
*Attorney, Agent, or Firm*—Harry M. Weiss

[57] ABSTRACT

A dally practice apparatus for practicing the wrapping of a first end or a rope around a saddlehorn, a second end of said rope being coupled to a load which applies tension to said rope when said load is lifted, said first end of said rope extending towards said rider for steering said rope.

3 Claims, 4 Drawing Figures

DALLY PRACTICE APPARATUS

BACKGROUND OF THE INVENTION

1. Field of the Invention

This invention relates generally to exercise apparatus and, more particularly, to a dally practice apparatus.

2. Description of the Prior Art

The popularity of western style rodeo is ever increasing, and more and more athletes are being drawn into the sport. One very popular event is referred to as steer roping. In this event a rider on horseback pursues a steer and ropes it around the head or around the hind legs. During the roping phase, the rider performs what is referred to as a dally: i.e., the wrapping of a rope around the horn of a saddle after the steer has been roped.

Since competitive times may differ by only hundreds of a second, it is extremely important that each phase be performed as rapidly as possible. This requires many hours of practice. While roping can be practiced in any one of a variety of settings, there are as yet no convenient means for practicing the dally.

SUMMARY OF THE INVENTION

It is an object of the invention to provide a dally practice apparatus.

It is a further object of the invention to provide a dally practice apparatus which is portable and easy to employ and deploy.

According to a broad aspect of the invention we have provided an exercise apparatus of a type wherein a load is manually elevated by pulling on a first end of a connecting means having a second end coupled to said load, said apparatus comprising, a substantially vertical support member: first guide means coupled to an upper portion of said vertical member for steering said connecting means, and the second guide means coupled to an intermediate portion of said vertical member below said first guide means for steering said connecting means.

The above and other objects, features, and advantages of the present invention will be more clearly understood from the following detailed description taken in conjunction with the accompanying drawings.

DESCRIPTION OF THE PREFERRED EMBODIMENT

Figure 1:
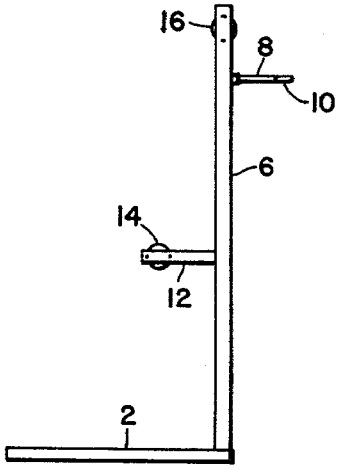
FIGS. 1, 2 and 3 are side, front and top views respectively of the inventive dally practice apparatus
Figure 2:
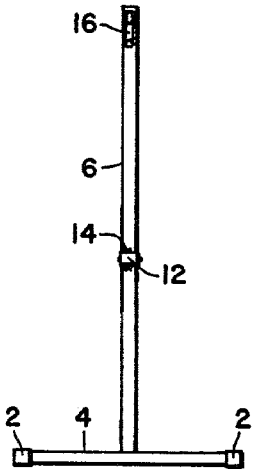
Figure 3:
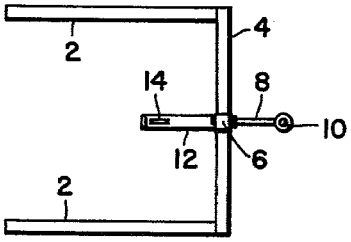

FIGS. 1, 2 and 3 are side, front and top views respectively of the inventive dally practice apparatus. A "U" shaped supporter base member comprises leg members 2 and a cross member 4. A substantially vertical number 6 is coupled to the cross member 4 at a point intermediate its length and extends upward therefrom. An extension 12 is coupled at one end to vertical member 6 and has a roller wheel 14 coupled at its other end. A second roller wheel 16 is rotatiably coupled near the upper end of vertical number 6. A second projection 8 is coupled to the vertical member and extends horizontally therefrom in a direction opposite that of projection 12. Member 8 terminates with a guide member 10; e.g. an eyelet. Leg members 2, cross member 4 and vertical member 6 may be made from any material which supplies the necessary rigidity; e.g. metal, wood, etc. Metal pipe has been found to work quite satisfactorily.

Figure 4:
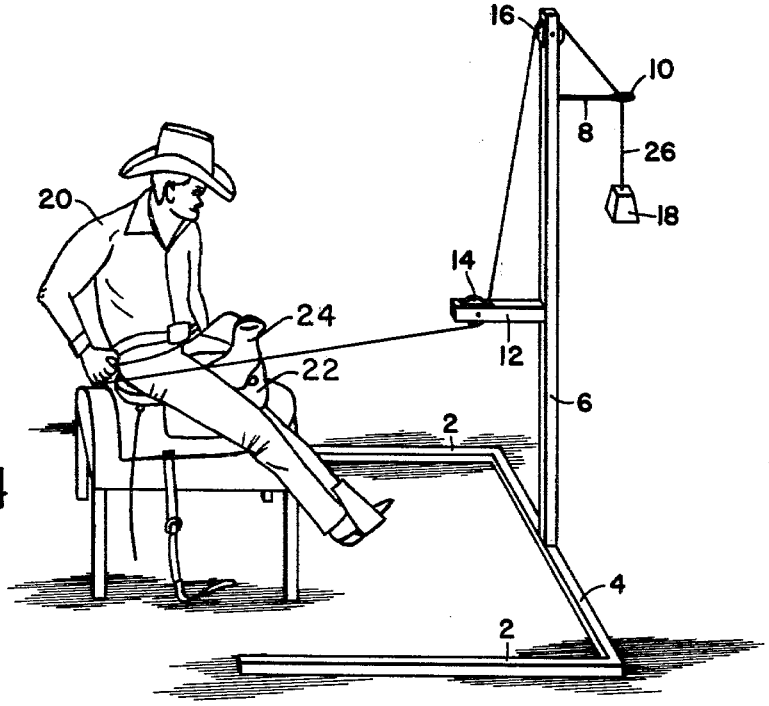
FIG. 4 is a drawing illustrating how the inventive practice apparatus is employed.

The use of the inventive dally practice apparatus may best be described in conjunction with FIG. 4. A rope 26 is fastened at one end to a load 18. The other end of the rope is passed through eyelet 10 over roller 16 and under roller 14. A rider 20 positions himself on a saddle 22 which is equipped with a saddlehorn 24. By pulling on the rope and elevating the load, the rider simulates the roping of a steer. The rider may then repeatedly practice looping the rope around the saddlehorn as is shown in FIG. 4.

It should be appreciated that the above described configuration requires very little room and affords a convenient and simple means by which a rider can perfect his dally and improve his time. It should be further appreciated that the base consisting of members 2 and a cross member 4 may be eliminated if the vertical member 6 is embeded and secured in the ground.

The above description is given by way of example only. Changes in form and detail may be made by one skilled in the art without departing from the spirit and scope of the invention as defined by the appended claims.

What is claimed is:

1. A dally practice apparatus, comprising: an immovable saddle supported above an apparatus support surface and having a saddle horn for permitting a person to assume the posture of a horse rider;

a rope having one portion accessible to said person in said saddle and a load means including a weight connected to said rope for loading said rope at a portion thereof spaced from said one portion so that said person in said saddle can practice a dally with said rope being maintained in tension;

a first roller coupled to said rope intermediate said portions and further having a fixed location with respect to said saddle;

said rope having a portion located between said first roller and said saddle at a location below the upper limit of said saddle horn.

2. A practice apparatus in accordance with claim 1, wherein said apparatus further comprising:

at least a vertical member having a fixed location with respect to said saddle and further having said first roller coupled to a medial region thereof;

a second roller coupled to said vertical member above said first roller and further having said rope reeved thereover; and said second roller being located between said first roller and said weight so that said vertical member suspends said weight when said person practices a dally.

3. A practice apparatus in accordance with claim 2 further comprising guide means for spacing said weight from said vertical member so that interference therebetween is avoided.

* * * * *